US010450122B2

(12) United States Patent
Tansingco

(10) Patent No.: US 10,450,122 B2
(45) Date of Patent: Oct. 22, 2019

(54) CUSHIONING PACK FOR ARTICLES OF DIFFERENT SIZE

(71) Applicant: REFLEX PACKAGING INC., Santa Ana, CA (US)

(72) Inventor: Edward Tansingco, Santa Ana, CA (US)

(73) Assignee: Reflex Packaging Inc., Santa Ana, CA (US)

( * ) Notice: Subject to any disclaimer, the term of this patent is extended or adjusted under 35 U.S.C. 154(b) by 0 days.

(21) Appl. No.: 15/895,406

(22) Filed: Feb. 13, 2018

(65) Prior Publication Data

US 2019/0248561 A1 Aug. 15, 2019

(51) Int. Cl.
*B65D 81/07* (2006.01)

(52) U.S. Cl.
CPC ..... *B65D 81/07* (2013.01)

(58) Field of Classification Search
CPC .. B65D 81/07; B65D 81/107; B65D 81/1075; B65D 81/113
USPC ..... 206/521, 523, 524, 583, 585, 587, 588, 206/591, 592; 229/87.02
See application file for complete search history.

(56) References Cited

U.S. PATENT DOCUMENTS 1,156,074 A * 10/1915 Hahn ..... B65D 5/5035 206/482
3,854,650 A * 12/1974 Hanaue ..... B65D 81/107 16/DIG. 13
4,840,277 A * 6/1989 Waldner ..... B65D 81/113 206/523
5,207,327 A * 5/1993 Brondos ..... B65D 5/509 206/521
5,405,000 A * 4/1995 Hagedon ..... B65D 81/075 206/216
6,167,790 B1 * 1/2001 Bambara ..... B32B 5/18 83/13
6,298,989 B1 * 10/2001 Chu ..... B65D 81/025 206/320
6,499,599 B1 * 12/2002 Hopkins ..... B65D 81/058 206/523

(Continued)

OTHER PUBLICATIONS

Pregis North America, Airspeed Chamberpak Custom Cellular Cushioning, 2018, Web Feb. 13, 2018, <http://www.pregis.us/productsandservices/productsolutions/inflatablesystems/cushioning/airspeedchamberpak.aspx>.

(Continued)

*Primary Examiner* — Jacob K Ackun
*Assistant Examiner* — Jenine Pagan
(74) *Attorney, Agent, or Firm* — Laubscher & Laubscher, P.C.

(57) ABSTRACT

A cushioning pack of unitary construction has a resilient base defining an article-receiving region for accommodating a shock-sensitive article. The article-receiving region has a platform on which the article can be placed. A cushioning structure bounds the article-receiving region. One or more arrays of upstanding article-retaining studs are formed in the base and bound a portion of the article-receiving region on the platform. The article-retaining studs have a cut partially surrounding the article-retaining studs so as to leave a hinge portion permitting the article-retaining studs to be depressed into the base so that the article-retaining studs are resistant to lateral forces but submissive to vertical forces. The pack can thus accommodate articles of different sizes.

20 Claims, 6 Drawing Sheets

(56) References Cited

U.S. PATENT DOCUMENTS

| | | | | |
|---|---|---|---|---|
| 6,520,337 | B2 | 2/2003 | Smith | |
| 7,114,618 | B2 * | 10/2006 | Arnold | B65D 81/107 206/523 |
| 7,398,884 | B2 * | 7/2008 | Stegner | B65D 81/113 206/521 |
| 7,882,956 | B2 | 2/2011 | McDonald et al. | |
| 7,891,494 | B2 * | 2/2011 | Smith | B65D 25/107 206/523 |
| 9,150,343 | B2 * | 10/2015 | Roberts | B65D 81/075 |
| 9,233,787 | B2 * | 1/2016 | Nakamura | B65D 81/054 |
| 2001/0020595 | A1 * | 9/2001 | Koike | B65D 81/025 206/521 |
| 2013/0100359 | A1 * | 4/2013 | Yokawa | B65D 81/113 348/836 |
| 2016/0052691 | A1 * | 2/2016 | Ridgeway | B65D 81/07 206/583 |

OTHER PUBLICATIONS

Sealed Air, Korrvu Suspension and Retention Packaging, 2018, Web Feb. 13, 2018, <https://sealedair.com/product-care-solutions/cushioning-solutions/suspension-retention/korrvu>.

Tenxionpak, One Solution for Multiple Product Lines, 2011, Web Feb. 13, 2018, <http://www.tenxionpak.com/>.

* cited by examiner

CUSHIONING PACK FOR ARTICLES OF DIFFERENT SIZE

FIELD OF THE INVENTION

This invention relates to fragility packaging, and more particularly to a cushioning pack for transporting shock sensitive products.

BACKGROUND OF THE INVENTION

Certain electronic products, such as smartphones and laptops, are highly sensitive to impact shocks and thus must be protected during shipment with cushioning materials. Traditional materials, such Styrofoam, are environmentally unfriendly. U.S. Pat. No. 6,520,337, the contents of which are herein incorporated by reference, describes a unitary product cushioning pack for a shock sensitive product, which is made of a thermoformed plastics material that is capable of providing impact shock protection in three mutually perpendicular directions. The thermoformed plastics material typically has an initial thickness between 0.050 and 0.1 inches. This cushioning pack has a cushioning structure that bounds an article-receiving region for accommodating the article to be protected. The article-receiving region is sized to make a snug fit with the article so as to prevent movement transit. This works well for articles of the same size, such as newly manufactured laptops being shipped for sale.

It is however not only new products that need to be shipped. Consumers often need to return used articles, for example to a repair facility, or to have replacement batteries installed. In this case the articles may have different sizes. For example, different generations of iPhones come in different sizes. While shock sensitive packaging can be customized for a particular manufacture manufacturing a large number of products of the same size, it is not practical to offer a wide range of packaging options to the consumer, who merely has a one-off shipment.

SUMMARY OF THE INVENTION

Embodiments of the invention provide a cushioning pack that will provide protection for shock sensitive products of different sizes.

According to the present invention there is provided a cushioning pack of unitary construction comprising a resilient base defining an article-receiving region for accommodating a shock-sensitive article, the article-receiving region having a platform on which the article can be placed; a cushioning structure bounding said article-receiving region; at least one array of upstanding article-retaining studs formed in said base and occupying at least a portion of said article-receiving region on said platform, said article-retaining studs having a cut partially surrounding said article-retaining studs so as to leave a hinge portion permitting the article-retaining studs to be depressed into said base.

The cushioning pack may conveniently be thermoformed, for example, from a sheet of HDPE (high density polythene sheet), but in the alternative, and less desirably, may be made by injection molding.

It will be understood that the reference to lateral and vertical forces relates to the cushioning package when laid flat on a horizontal surface.

The article-retaining studs of each array may be arranged in one or more rows, or may also be arranged in a staggered pattern.

After thermoforming, the cuts may be made at a die cutting station with steel rule dies making the cuts.

The cushioning pack may be fitted with a conformal cover designed to press down on the article in the pack. Alternatively, for, example, in the case of bulkier objects, the article to be protected may be sandwiched between a pair of cushioning packs, wherein one is the mirror image of the other, with the upper pack being inverted.

In another aspect the invention provides a cushioning pack comprising a resilient base of unitary construction defining an article-receiving region for accommodating a shock-sensitive article, the article-receiving region having a platform on which the article can be placed; a cushioning structure bounding said article-receiving region; at least one array of article-retaining studs bounding at least a portion of the article-receiving region on said platform, said article-retaining studs being resistant to lateral forces but submissive to vertical forces; and a resilient cover fittable over said resilient base to apply vertical pressure to said article and depress said article-retaining studs lying within a perimeter of the article.

The studs may be hinged so as to be pivoted downwardly in the presence of an overlying article. The hinges are preferably oriented perpendicular to adjacent sides of an article placed in the article-receiving area, but may also be arranged in a parallel orientation, in which case they may also include projecting tabs extending under the article to prevent upwards pivotal movement in the presence of lateral forces.

Alternatively, the article-retaining studs may be formed so that they are crushable under vertical forces such that when an article is placed in the article-receiving region such that it overlies the article-retaining studs, those within the perimeter of the article are crushed as the article is pressed into place the article-retaining region.

BRIEF DESCRIPTION OF THE DRAWINGS

The invention will now be described in more detail, by way of example only, with reference to the accompanying drawings, in which:—

DETAILED DESCRIPTION OF EMBODIMENTS OF THE INVENTION

Figure 1:
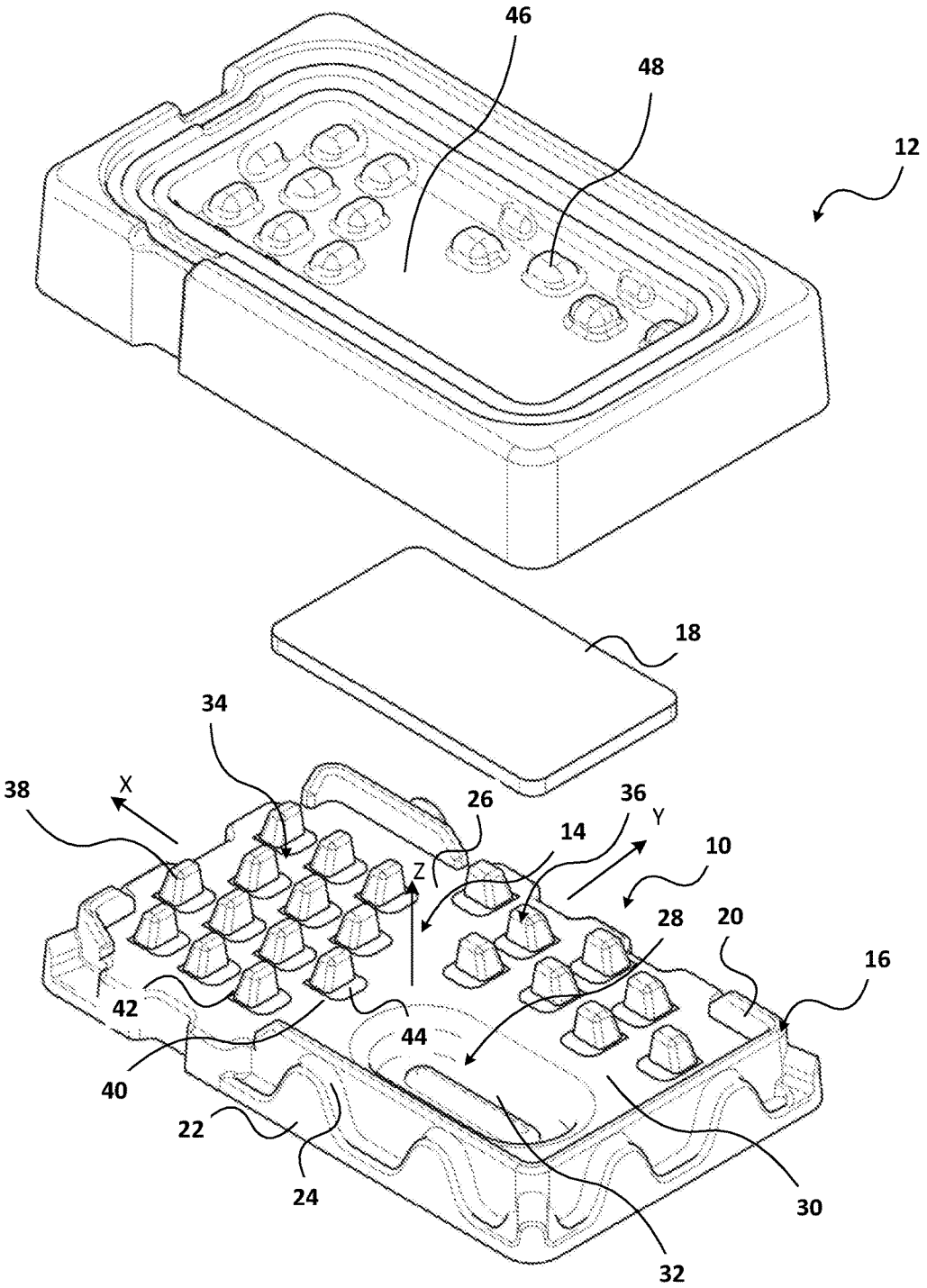
FIG. 1 is an exploded view of a cushioning pack in accordance with a first embodiment of the invention accommodating a small smartphone.

The cushioning pack shown in FIG. 1 employs similar principles to the cushioning pack disclosed in U.S. Pat. No. 6,520,337. In this embodiment the cushioning pack has a base 10 of unitary construction made from a thermoformed sheet of resilient plastic, typically having an initial thickness of from 0.02 to 0.03 inches for smartphones. Greater thicknesses can be employed for heavier items. A conformal cover 12 also made from a thermoformed sheet of resilient plastic, may be fitted over the base. The thickness of the sheets may be selected to determine the desired stiffness of the base 10 and cover 12. In this non-limiting example, the resilient plastics material is 0.03" HDPE (high density polyethylene).

In an alternative embodiment the base 10 and/or the cover 12 may be made by injection molding. The base 10 defines an article-receiving region 14 bounded by a cushioning structure 16. The cushioning structure 16 comprises the inner retaining wall 20, an outer wall 22, and a spring transition region 24, which may be similar in principle to that described in U.S. Pat. No. 6,520,337.

The cushioning structure 16 provides cushioning in the X, Y and Z directions. By way of non-limiting example the article will be assumed to be a smartphone 18.

The article-receiving region 14 has a bottom platform 26 on which the smartphone 18 is laid. Unlike the situation disclosed in U.S. Pat. No. 6,520,337, the article-receiving region 14 may be sized substantially larger than the smartphone 18.

The article-receiving region includes a generally rectangular corner region 28, which has a flat peripheral portion 30 with a central well 32. The optional central well 32 forms a bulge on the underside additional support on the underside, especially for heavier items. Generally, in the case of a smartphone, it is not needed. In this embodiment the smartphone 18 is placed so as to abut the inner retaining wall 20 along one of its short and long sides respectively in the corner region 28.

Arrays 34, 36 of upstanding studs 38 are arranged on the bottom platform 26. The first array 34 comprises several rows of studs 38 facing and leaning slightly towards the short side of the corner region 28 and the second array 36 also comprises rows of studs 38 facing and leaning slightly towards the long side of the corner region. The studs 38 have a generally truncated pyramidal shape.

The studs 38 are resistant to lateral forces in the X-Y directions, but are submissive to vertical forces to deflect downwardly when pressure is applied in the Z direction.

To facilitate downward deflection a U-shaped cut 40 is made on the side of the studs 38 facing the smartphone 18 leaving a hinge portion 42 on the opposite side. This can be made in the thermoforming machine or later in a die cutting station using steel rule dies. The U-shaped cut 40 defines a tab 44.

In the embodiment shown in FIG. 1, the smartphone 18 is sized to fit snugly in the corner region 28 abutting the inner retaining wall 20 on two sides and the innermost rows of the arrays 34, 36 on the other two sides. In this case the innermost rows of studs 38 provide resistance to lateral forces and hold the smartphone 18 firmly in place.

The conformal cover 12, which has a depressed central region 46, is then firmly fitted over the base 10. The bulges 48 define recesses on the underside of the cover that accommodate the exposed studs 38 so that the underside of the depressed region of the cover 10 may be pressed firmly against the smartphone 18 to retain it in the vertical direction. The cushioning pack then provides good cushioning against shocks in all three dimensions.

Figure 2:
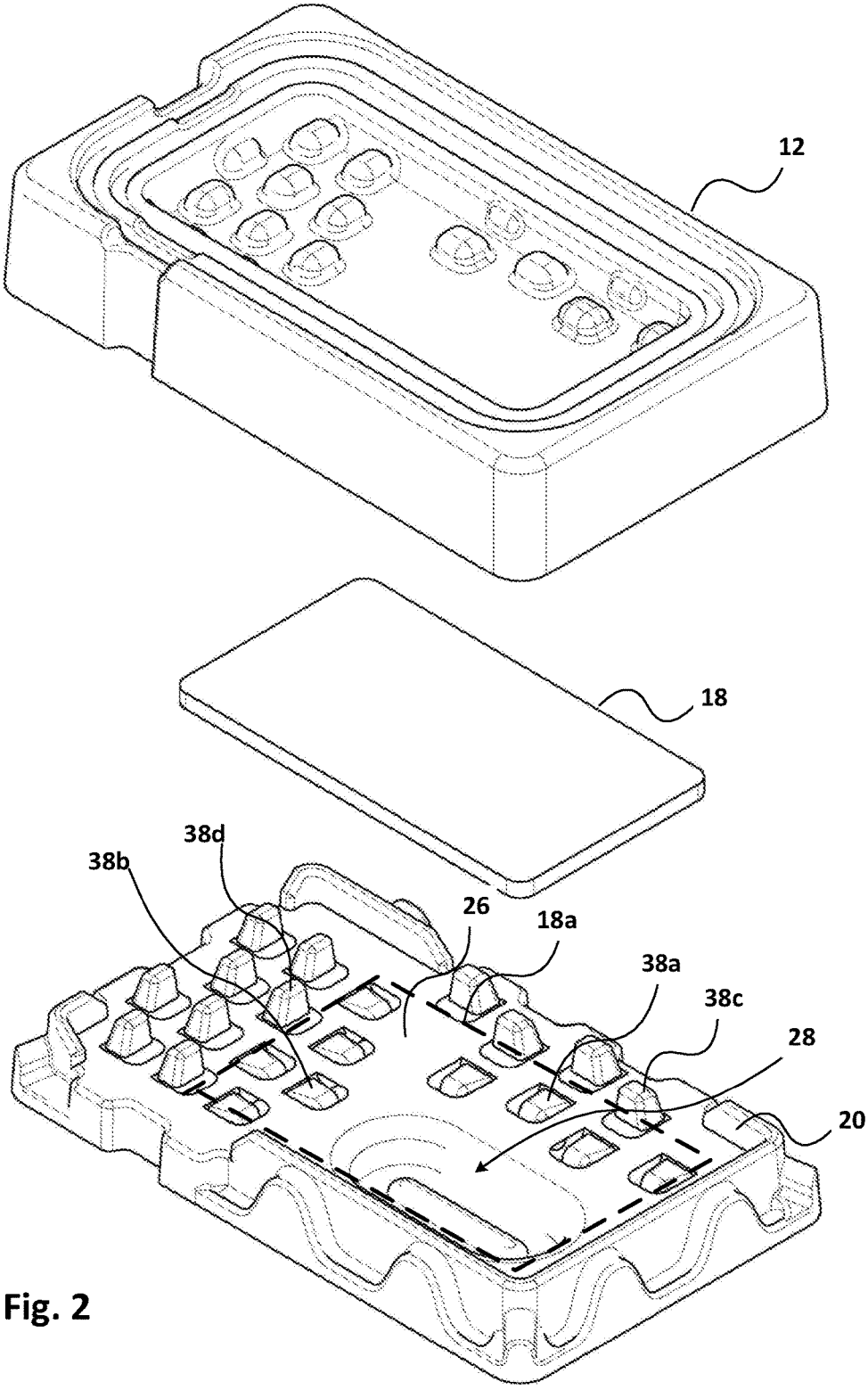
FIG. 2 is an exploded view of the cushioning pack accommodating a larger smartphone.

In the embodiment shown in FIG. 2, the smartphone 18 is larger than the corner region 28. When the smartphone 18 is placed in the corner region 28 as shown in dashed outline as 18*a*, the innermost studs 38*a*, 38*b* lying within the perimeter of the smartphone 18 and therefore underneath it are depressed downwards into the platform 26, allowing the smartphone 18 to fit snugly on the platform 26 bounded by the remaining upstanding studs 38*c*, 38*d* lying outside the perimeter of the smartphone 18. The upstanding studs 38*c*, 38*d* serve to retain the smartphone 18 against lateral movement.

It will be seen that, in this way, smartphones of different size can be accommodated. An even larger smartphone may occupy the entire article-receiving region 14, in which case the all the studs 38 will be depressed into the platform 26 and the smartphone 18 will be retained on all sides by the inner wall 20.

As in the embodiment of FIG. 1, when the smartphone 18 has been put in place, the conformal cover 12 is then firmly fitted over the base 10 to retain the smartphone 18 in the vertical direction.

Advantageously, the arrays of studs are arranged along only two sides of the smartphone 18 because then full advantage can be taken of the inner or retaining wall 20 along two sides, but it will be appreciated that alternatively the arrays of studs 38 could completely surround the smartphone 18, in which case a smartphone 18 smaller than the article-receiving region would be retained by the studs 38 on all four sides.

Figure 3A:
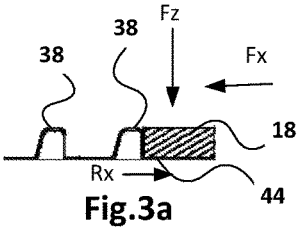
FIGS. 3*a* and 3*b* are respectively side and plan views of a portion of the platform showing a smartphone restrained by an inner retaining stud.
Figure 3B:
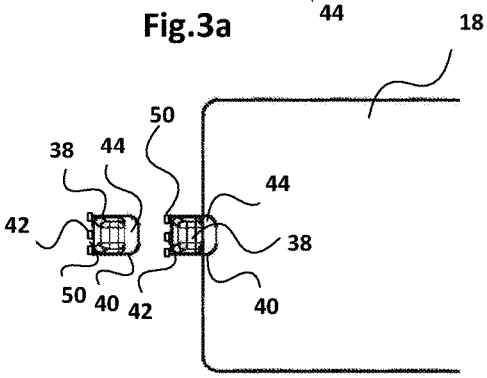

FIGS. 3*a* and 3*b* show a pair of studs 38 in more detail. They generally have the shape of a truncated pyramid leaning slightly toward the front. A line of perforations 50 extends along the back edge of the studs 38 in the hinge region 42 to further facilitate flexing of the stud into the platform 26. It will be noted that the U-shaped cut defines the tab 44.

As illustrated in FIG. 3*a*, when the edge of a smartphone 18 exerts a lateral force Fx on the stud 38, it exerts a reaction for Rx in the opposite direction to lock the smartphone 18 in place. The smartphone also exerts a downward force Fz on the tab 44, which prevents the lateral force Fx from pivoting the stud rearwards about the hinge 42.

Figure 4A:
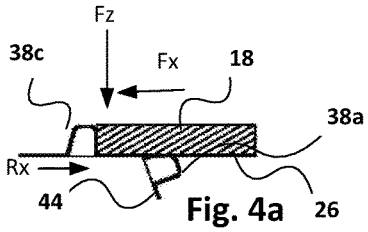
FIGS. 4*a* and 4*b* are respectively side and plan views of a portion of the platform showing a smartphone depressing a first retaining stud and being restrained by a second retaining stud.
Figure 4B:
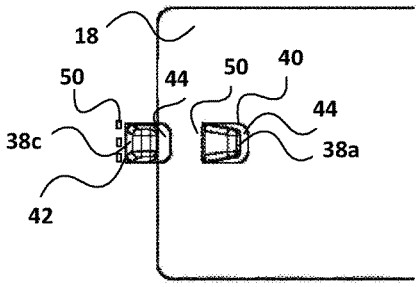

FIGS. 4*a* and 4*b* show what happens to a stud 38*a* depressed by the smartphone 18. The stud 38*a* pivots downwards about the hinge 50, leaving room for the smartphone 18 to be retained firmly in place by the remaining stud 38*c*. In FIGS. 4*a* and 4*b* the stud 38*a* can be seen depressed under the smartphone 18 below the plane of the platform 26.

It will be appreciated that the cushioning pack is not only applicable to rectangular articles. In that case the arrays would be arranged in formations to cover other geometric shapes, such as circles or polygons.

The exemplary cushioning pack has been illustrated in association with the conformal cover 12. In certain applications, it may be possible to dispense with the cover, for example, if more than one item is shipped in a series of stacked cushioning packs, or if the pack is placed in an outer container, for example, as illustrated in U.S. Pat. No. 6,520,337.

Figure 5:
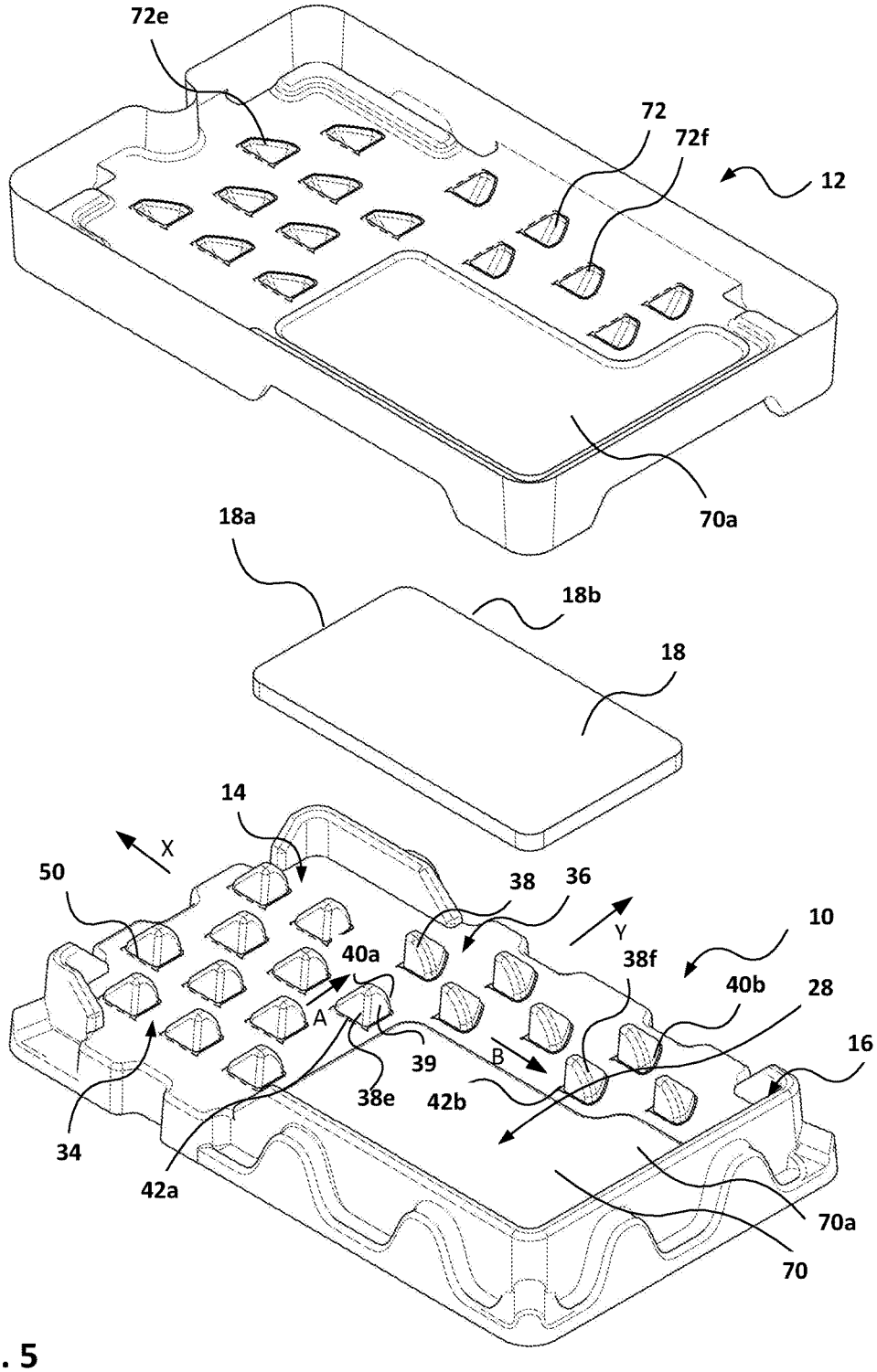
FIG. 5 is an exploded view of a cushioning pack in accordance with another embodiment of the invention.

In the embodiment shown in FIG. 5, the arrays 34, 36 are located on the base 10 in a similar manner to the embodiment shown in FIGS. 1 and 2, but the studs 38 are oriented sideways to the edges of the smartphone 18. For example, a hinge line 42*a* of the stud 38*e* is oriented perpendicular to the edge 18*a* of the smartphone 18 and the closed end of the U-shaped cut 40*a* points to the right in the direction of arrow A in FIG. 5 so that the stud 38*e* pivots downwards about the hinge line 42*a* extending in the X-direction.

Similarly, hinge line 42*b* of stud 38*f* extends in the Y-direction and the closed end of the U-shaped cut 40*b* ends in the direction of the arrow B so that the stud 38*f* pivots downwards in the direction of the arrow B.

The studs 38 have a generally trunco-pyramidal shape with flat faces 39 facing the smartphone 18 when located in the article-receiving region 14.

The studs 38 of each of the respective arrays 34, 36 are oriented in the same direction, that is all the studs 38 of array 34 are oriented in one direction and the studs 38 of array 36 are oriented in a second direction perpendicular to the first. The may be aligned in rows or staggered.

In this embodiment the corner region 28 is defined by a flat area 70 with an extension 70*a*. In the case shown in FIG. 5, the smartphone 18 fits in the corner region 28 without the need to depress any studs 38. It has been found that orienting the studs 38 with the hinge axes 40 perpendicular to the adjacent sides 18*a*, 18*b* of the smartphone 18 may provide even better shock resistance than is the case for the embodiment shown in FIGS. 1 and 2. For example, in one test an Iphone 5 was dropped from a height of 48 inches onto a hard floor without damage. Also, with the studs 38 oriented in this manner the tabs shown in FIG. 1 are no longer necessary because the lateral forces applied by the smartphone to the studs 38 are not in a direction tending to cause them to pivot about the hinges 42.

In this embodiment the cover 12 fits snugly over the base 10, but instead of being entirely conformal with recesses accommodating the studs 38 of the base, the cover 12 has studs 72 operating on a similar principle to studs 38, but which are offset or interlaced in relation to the studs 38 when the cover is placed on the base. In samples tested, where the top and bottom studs form an interlaced mesh, this arrangement has been found to give even greater resistance to lateral movement.

In the scenario shown in FIG. 5, as the smartphone 18 fits within the corner region 28 and corresponding region 70*a* in the cover 12 no studs are depressed.

Figure 6:
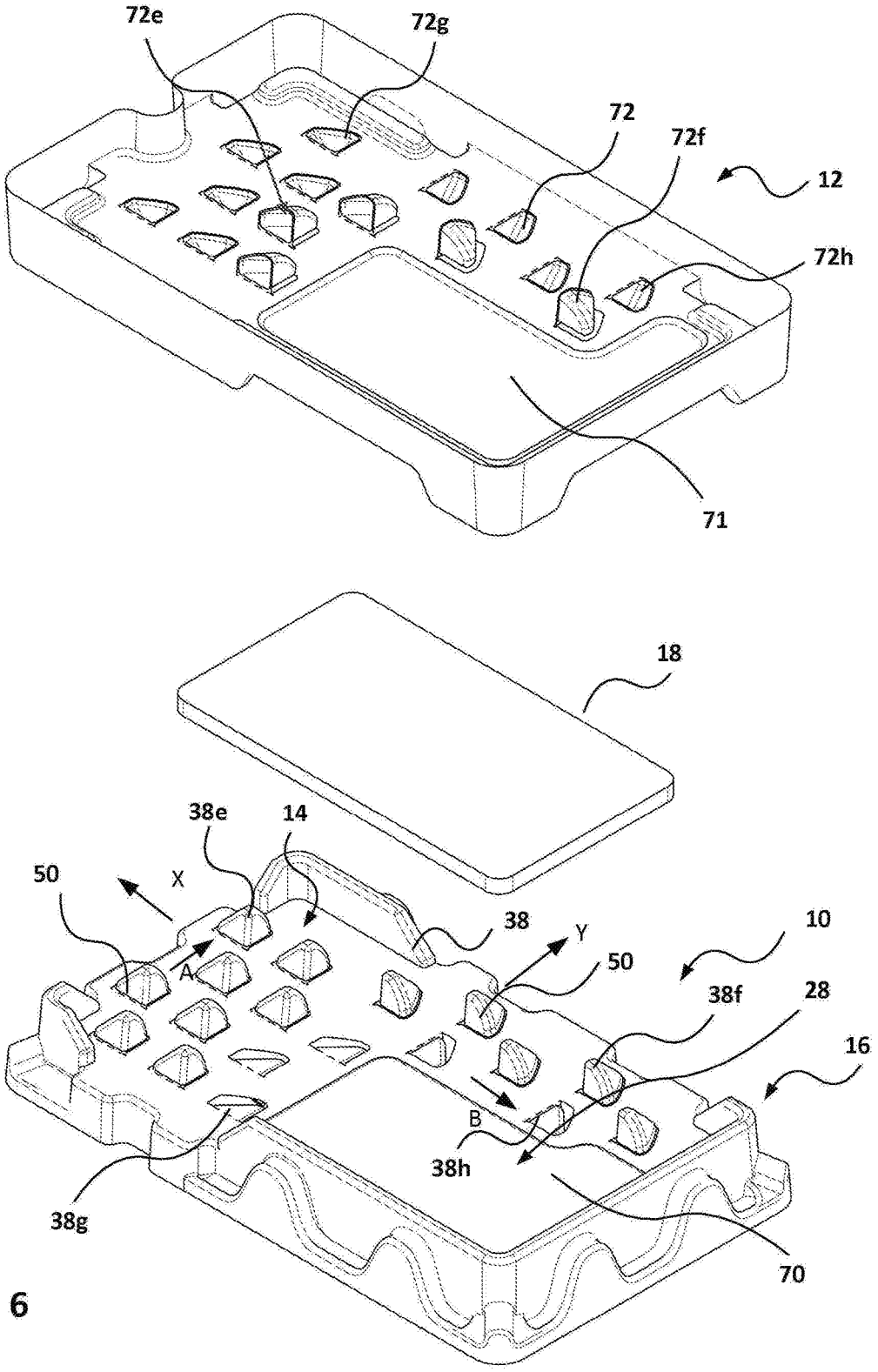
FIG. 6 is an exploded view of the cushioning pack shown in FIG. 5 with a larger smartphone.

In the scenario shown in FIG. 6, the smartphone 18 is slightly larger than the region 70 and the studs 38*g* and 38*h* are depressed leaving studs 38*e* and 38*f* upstanding.

Likewise on the cover 12, studs 72*e* and 72*f* are depressed leaving studs 72*g*, 72*h* upstanding. It will be seen that the cover 12 in FIG. 6 is shown inverted so the studs 38 that are depressed by the smartphone 18 in the article-receiving region 14 appear as upstanding and vice versa.

If the smartphone completely occupies the article-receiving region 14, then all the studs 38, 72 will be depressed in both the base 10 and cover 12.

Figure 7:
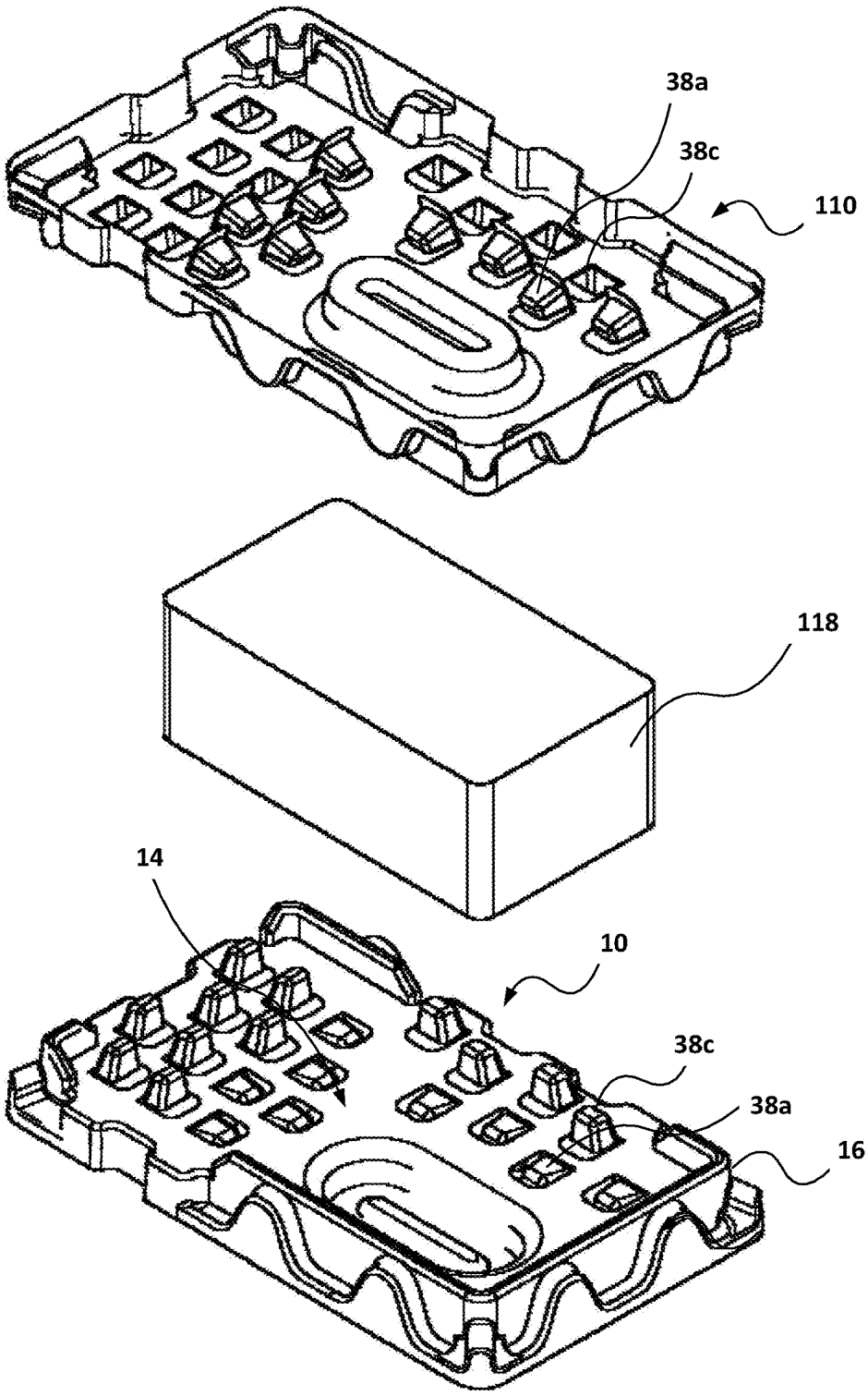
FIG. 7 is an exploded view of a pair of cushioning packs applied to a bulky article.

In other applications, the cushioning packs can be applied in an opposed relationship as end packs on to bulkier items. Such an arrangement is shown in FIG. 7. In this case the article to be shipped is a bulky item 118. It is sandwiched between two packs 10, 110, the pack 110 being a mirror image of the pack 10 and being inverted to fit on the topside of the item 118.

In the preferred embodiments illustrated the studs 18 are relatively stiff and easily pivoted about the hinge 50 into the space below the platform 26 due to the pressure applied by the smartphone 18 or other article. In an alternative embodiment, instead of employing the hinges 50 and cut-outs 40, the studs 38 could be weakened to the point whereby downwards pressure (or upwards in the case of the cover) under the smartphone crushes them, leaving the smartphone retained by the remaining studs. However, this embodiment may not give the same degree of lateral restraint.

The cushioning pack is particularly useful for consumers wishing to return shock-sensitive items for service because a single package can provide effective cushioning for a wide range of articles of different shapes and sizes.

The invention claimed is:

1. A cushioning pack of unitary construction for cushioning shock-sensitive articles of different size, comprising:

a resilient base defining an article-receiving region for accommodating a the shock-sensitive article, the article-receiving region having a platform on which the shock-sensitive article can be placed;

a cushioning structure defining an inner article-retaining wall bounding said article-receiving region and serving to retain the shock-sensitive article of a size occupying the entire said article-receiving region;

at least one array of upstanding article-retaining studs formed in said base and occupying at least a portion of said article-receiving region on said platform, said article-retaining studs having a cut partially surrounding said article-retaining studs so as to leave a hinge portion permitting the article-retaining studs to be depressed into said based whereby said article-retaining studs are resistant to lateral forces but submissive to vertical forces generated by an overlying of the shock-sensitive article placed in said article-receiving region, and said at least one array of article-retaining studs being configured such that when the shock-sensitive article is of a size less than said article-receiving region to expose a group of said article-retaining studs is placed in said article-receiving region, the shock-sensitive article of a size less than said article-receiving region is laterally retained in said article-receiving region by said exposed group of said article-retaining studs.

2. The cushioning pack of claim 1, wherein said hinge portion contains a line of perforations to facilitate flexing of the hinge.

3. The cushioning pack of claim 1, wherein said upstanding studs each have a face directed inwardly of said article-receiving region for abutting the shock-sensitive article of a size smaller than said article-receiving region, and said hinge portion is oriented perpendicular to said inwardly directed face.

4. The cushioning pack of claim 1, wherein said upstanding studs each have a face directed inwardly of said article receiving region for abutting the shock-sensitive article of a size smaller than said article-receiving region, said hinge portion is oriented parallel to said inwardly directed face, and said cut defines a tab attached to said stud for protruding from said face to extend under the shock-sensitive article of a size smaller than said article-receiving region placed in said article-receiving region and thereby inhibit upward pivoting movement of the article-retaining studs in response to lateral forces.

5. The cushioning pack of claim 1, wherein said article-receiving region is generally rectangular, and said arrays are arranged in an L-shape within said article-receiving region.

6. The cushioning pack of claim 1, further comprising an outer wall connected to said inner article-retaining wall by a spring transition region defining said cushioning structure.

7. The cushioning pack of claim 1, wherein said article-retaining studs have a generally trunco-pyramidal shape with flat faces facing an article placed in said article-receiving region.

8. The cushioning pack of claim 1, wherein said base is made from a thermoformed sheet.

9. The cushioning pack of claim 1, further comprising a central well in said article-receiving region.

10. The cushioning pack of claim 1 in combination with a resilient cover snugly fittable over said base to hold the article in place on said base.

11. The cushioning pack of claim 9, wherein said cover has article-retaining studs depressable into said cover and that are offset in relation to said article-retaining studs on said base.

12. The cushioning pack of claim 10, wherein said cover is made from a thermoformed sheet.

13. A cushioning pack for cushioning shock-sensitive articles of different size comprising:

a resilient base of unitary construction defining an article-receiving region for accommodating a shock-sensitive article, the article-receiving region having a platform on which the article can be placed;

a cushioning structure defining an inner article-retaining wall bounding said article-receiving region and serving to retain the shock-sensitive article of a size occupying the entire said article-receiving region;

at least one array of upstanding article-retaining studs formed within said article-receiving region on said platform, said article-retaining studs being resistant to lateral forces but submissive to vertical forces generated by an overlying of the shock-sensitive article placed in said article-receiving region, and said at least one array of article-retaining studs being configured such that when the shock-sensitive article is of a size less than said article-receiving region to expose a group of said article-retaining studs placed in said article-receiving region, the shock-sensitive article of a size less than said article-receiving region is laterally retained in said article-receiving region by said exposed group of said article-retaining studs; and a resilient cover fittable over said resilient base to apply vertical pressure to said article and depress said article-retaining studs lying within a perimeter of the article.

14. The cushioning pack of claim 12, further comprising a cut partially surrounding the article-retaining studs to leave a hinge portion allowing pivoting of the article-retaining studs into the resilient base.

15. The cushioning pack of claim 14, wherein said hinge portion contains a line of perforations to facilitate flexing of the hinge.

16. The cushioning pack of claim 14, wherein said upstanding studs each have a face directed inwardly of said article-receiving region for abutting the shock-sensitive article of a size smaller than said article-receiving region, and said hinge portion is oriented parallel to said inwardly directed face.

17. The cushioning pack of claim 16, wherein said article-receiving region is rectangular, and said arrays are arranged in an L-shape within said rectangular article-receiving region.

18. The cushioning pack claim 12, wherein said resilient cover also has at least one array of article-retaining studs, said article-retaining studs being resistant to lateral forces but submissive to vertical forces whereby said article-retaining studs lying outside a perimeter of the shock-sensitive article of a size smaller than said article-receiving region placed in said article-receiving region are depressed into said cover.

19. The cushioning pack of claim 18, wherein said article-retaining studs on said cover are offset in relation to said article-retaining studs on said base so as to form an interlaced mesh when the cover and base are fitted together.

20. The cushioning pack of claim 14, wherein said upstanding studs each have a face directed inwardly of said article-receiving region for abutting the shock-sensitive article of a size smaller than said article-receiving region, and said upstanding studs have a face directed inwardly of said article receiving region for abutting the shock-sensitive article of a size smaller than said article-receiving region, and wherein said hinge portion is oriented parallel to said inwardly directed face, and said cut defines a tab attached to said stud for protruding from said face to extend under the shock-sensitive article of a size smaller than said article-receiving region placed in said article-receiving region to inhibit upward pivoting movement of the article-retaining studs in response to lateral forces.

* * * * *